US005385341A

United States Patent [19]

Yamada et al.

[11] Patent Number: 5,385,341

[45] Date of Patent: Jan. 31, 1995

[54] AUTOMATIC DOCUMENT CONVEYING APPARATUS

[75] Inventors: Yasushi Yamada; Tetsuo Hirata, both of Hachioji; Tadashi Uematsu, Oizumi; Hiroyuki Hara, Kamifukuoka, all of Japan

[73] Assignee: Konica Corporation, Tokyo, Japan

[21] Appl. No.: 83,026

[22] Filed: Jun. 25, 1993

[30] Foreign Application Priority Data

Jul. 14, 1992 [JP] Japan ..... 4-187161

[51] Int. Cl.[6] ..... B65H 7/02

[52] U.S. Cl. ..... 271/265; 271/266; 271/275; 355/308

[58] Field of Search ..... 271/265, 266, 275; 355/308

[56] References Cited

U.S. PATENT DOCUMENTS

| | | | |
|---|---|---|---|
| 4,917,371 | 4/1990 | Bastow et al. | 271/275 X |
| 5,056,775 | 10/1991 | Kida | 271/265 X |
| 5,118,089 | 6/1992 | Yamada et al. | 271/266 X |
| 5,119,145 | 6/1992 | Honjo et al. | 271/265 X |
| 5,203,554 | 4/1993 | Suzuki et al. | 271/265 X |
| 5,204,724 | 4/1993 | Nakabayashi et al. | 271/275 X |

FOREIGN PATENT DOCUMENTS

| | | | |
|---|---|---|---|
| 60-140364 | 7/1985 | Japan . | |
| 51436 | 3/1986 | Japan | 271/266 |
| 102048 | 4/1991 | Japan | 271/266 |

*Primary Examiner*—Cheryl L. Gastineau

*Assistant Examiner*—Boris Milef

*Attorney, Agent, or Firm*—Frishauf, Holtz, Goodman & Woodward

[57] ABSTRACT

An automatic document conveying device has a stack tray on which a plurality of documents are stacked; a feeder by which the documents stacked on the stack tray are separated and fed one by one; at least one pair of conveying rollers provided downstream of the feeder; a reading position for reading document information from said separated documents positioned downstream of the at least one pair of conveying rollers; a conveyor provided opposite to the reader for conveying separated documents to the reading position; a discharger positioned downstream of said reading position for discharging documents after said conveyor conveys the documents to the reading position, a conveyance path on which a plurality of documents are sequentially located between the feeder and the reading position; the conveyance path having predetermined stand-by positions provided on the conveyance path at which documents, subsequent to a document positioned at the reading position are stopped; a document detector provided between the at least one pair of conveying rollers and the conveyor; an encoder which generates a pulse signal corresponding to a rotation of the conveyor; and pulse counter for counting the encoding pulses. A document conveyance to the reading position by the conveyor is controlled based on a number of pulses counted by the pulse counters on the basis of a detection timing by the document detector.

9 Claims, 6 Drawing Sheets

AUTOMATIC DOCUMENT CONVEYING APPARATUS

BACKGROUND OF THE INVENTION

The present invention relates to an automatic document conveying apparatus, and more particularly relates to an improvement in the apparatus by which the document is automatically conveyed to a reading position in a recording apparatus or an image reading apparatus of an electrophotographic copier.

Generally, the automatic document conveying apparatus is mounted on a platen glass of an image exposing section of the copier. In a travelling type optical system copier to which the automatic document conveying apparatus is mounted, documents are sent one by one by the automatic document conveying apparatus from a document tray (a stack section) on which the documents are stacked, and conveyed on the platen glass by a conveyance belt. Then, the document is exposed by a lamp of an exposing section, and after that, the document is conveyed to a document discharging tray.

In a document exchanging operation on the platen glass by the automatic document conveying apparatus, conventionally, after a sheet discharging sensor detects that the document on the platen glass has been discharged, the next document is fed from the stack section, conveyed onto the platen glass, and stopped at a predetermined position. In the foregoing, a long document exchanging time is necessary, and therefore, a long copy processing time is necessary, so that the copying efficiency is lowered.

At the time of the document exchanging operation by which the document is automatically fed onto the platen glass and discharged from it in the automatic document conveying apparatus, the copying efficiency is 100 %, and a long copy processing time is not necessary when the document is exchanged during the returning time of an optical scanning unit. Due to the foregoing, it is necessary to increase the document conveyance speed at which the document is conveyed from a document multi-feeding prevention position in the stack section to a document stop position on the platen glass.

However, when the document feeding speed is increased, the following problems are caused: a large-sized motor is necessary; electric power consumption is increased; noise is generated; the conveyance belt is worn out; a document is damaged; and the document separation properties are lowered.

As a technique to realize the document conveying apparatus by which the above-described problems are solved and the document exchanging time can be shortened without an increase of document conveyance speed, the assignee of the present invention have proposed an automatic document conveying apparatus structured as follows. (Japanese Patent Application No. 385/1992)

That is, a document is placed on the platen glass; succeeding documents are caused to stand by at predetermined waiting positions respectively with a predetermined distance therebetween; and these documents are sequentially placed in a row downstream from a separation feeding means, by which the document is separated and fed from the document tray, to the reading section on the platen glass.

In the above-described automatic document conveying apparatus, positioning of the documents with respect to the document reading position is carried out as follows: a driving motor is turned off after a detection timing by a document passage detecting sensor; and a leading edge of the document comes into contact with a document stopper protruded onto the upper surface of the platen glass. However, in the aforementioned method, the following problems are caused: a stop position of the document fluctuates, so that it is difficult to carry out highly accurate positioning stably; and it is necessary to provide a mechanism by which the document stopper is protruded onto or withdrawn from the upper surface of the platen glass.

Accordingly, the following method has been investigated: a document movement amount is detected when the number of pulses generated by a rotary encoder provided to a driving roller of the conveyance belt is counted on the basis of a passing time of the document by a register sensor; and when the number of counted pulses is equal to a predetermined number, a driving motor and an electromagnetic brake are controlled.

However, as described above, when a plurality of documents are sequentially placed in a row in order to shorten the document exchange time, especially in the case where the size of the document is small, there occurs a case where a plurality of documents are placed between the register sensor and the document reading position.

In this case, even when pulse counting is started in order to detect the stop position of the first document according to the signal of the sensor which has detected the passage of the first document, the next document passes through the sensor section before the number of counted pulses is equal to the number corresponding to the stop position. Therefore, in the structure in which a plurality of documents are placed on the conveyance path so that the document exchanging time is shortened, there occurs a case where the conveyance control by a simple pulse counting operation can not be applied to the system, which is a problem.

SUMMARY OF THE INVENTION

The object of the present invention is to provide an automatic document conveying apparatus, in which: a plurality of documents are sequentially placed in a row downstream from a separation feeding means, by which the documents are separated and fed, to a document reading section on a platen glass so that the document exchanging time can be shortened; and the document can be conveyed to and positioned at the reading section without a document stopper; and even when a plurality of documents are placed between a document passage detecting sensor and the reading section, each document movement amount is controlled so that the document can be positioned at the reading position.

In order to realize the foregoing object, the automatic document conveying apparatus of the present invention comprises: a stack tray on which a plurality of documents can be stacked; a separation feeding means by which the documents stacked on the stack tray are separated and fed one by one; a pair of conveying rollers provided downstream of the sheet feeding direction of the separation feeding means; a reading section of document information positioned downstream in the pairs of conveying rollers; a conveying means which is provided opposite to the reading section, and by which the document can be conveyed to the reading section; a discharging means by which the document discharged to the downstream side of the reading section by the conveying means is successively discharged; a conveyance path on which a plurality of documents can be sequentially located in a row between the separation feeding means and the reading section; predetermined stand-by positions on the conveyance path at which documents subsequent to the document positioned on the reading section are stopped and waited; a document detecting means provided between the pairs of conveying rollers and the conveying means; an encoder by which a pulse signal is generated corresponding to the rotation of the conveying means; and a pulse counter by which the number of pulses generated by the encoder is counted, wherein the document conveyance to the reading section by the conveying means is controlled according to the number of pulses counted by the pulse counter on the basis of a detection timing by the document detection means.

It is preferable that the document conveying apparatus is structured as follows: the same number of pulse counters as that of document sheets which are positioned between the document detection means and the reading section are provided; and when outputs of the plurality of pulse counters are processed in parallel, each of the movement amounts of the plurality of documents between the document detection means and the reading section is detected; and the conveyance of documents is controlled.

Further, it is preferable that the drive of the conveying means is stopped according to the counted value of the pulse counter by which the elapsed time from the detection timing of the document detection means is counted, and a brake of the conveying means is operated according to the counted value of the pulse counter, by which the elapsed time after the stop of the driving means is counted, so that the document is conveyed to the reading section.

Further, for the position at which the subsequent document is positioned, it is preferable that the next document to the document at the reading section stands by for the subsequent process bridging the space between the conveying means and the pair of second conveying rollers, and the document closest to the stack tray stands by for the subsequent process bridging the space between the separation feeding means and the pair of first conveying rollers.

Due to the foregoing automatic document conveying ! apparatus, the document to be read next can wait at a position close to the document placed on the reading section, and therefore the document exchanging time can be shortened. Further, the number of pulses generated by the encoder, by which the pulse signal is generated corresponding to the rotation of the conveying means, is counted, thereby the movement amount of the document is detected as the conveyance distance of the conveying means, and the document is conveyed to the reading section according to the movement amount detection.

When a plurality of documents are placed between the document detecting means and the reading section, and at least the same number of pulse counters as that of documents are provided, and when the pulse numbers counted by the counters are processed in parallel, the movement amount of each document can be controlled for conveyance.

Further, in the control of the document conveyance, when the drive or stop operation of the conveying means and the brake operation are also controlled by the pulse counter, the document positioning operation at the reading section can be accurately carried out.

When the next document to the document at the reading section stands by bridging the space between the conveying means and the pair of the second conveying rollers, and the document closest to the stack tray stands by bridging the space between the separation feeding means and the pair of the first conveying rollers, at least three documents can be sequentially located in a row on the conveyance path while keeping the conveyance stability.

BRIEF DESCRIPTION OF THE DRAWINGS

FIGS. 4(A) to 4 (H) are schematic illustrations explaining sheet feeding, conveying, and delivering operation processes of a plurality of documents.

DETAILED DESCRIPTION OF THE PREFERRED EMBODIMENT

Figure 1:
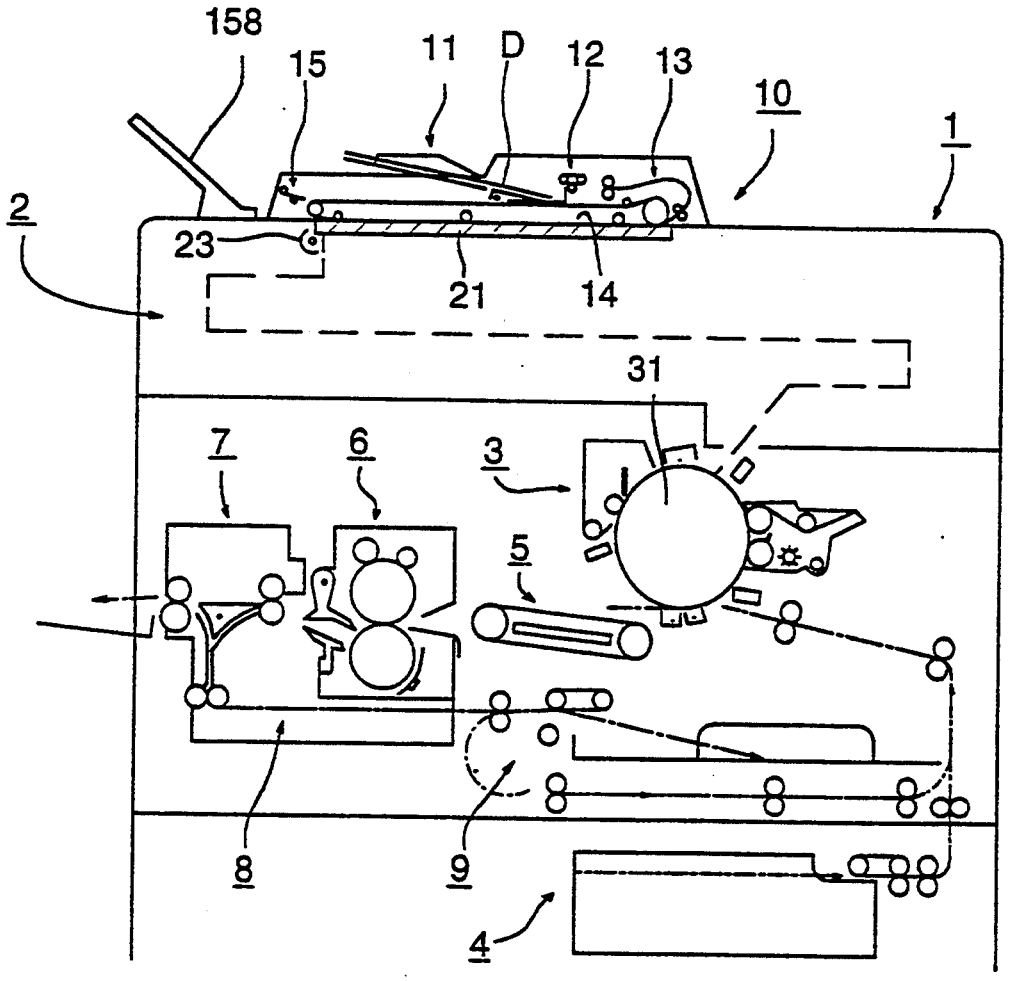
FIG. 1 is a view showing the entire structure of an image recording apparatus to which an automatic document conveying apparatus according to the present invention is provided.

Referring to the drawings, an example of the present invention will be described in detail as follows.

FIG. 1 is a view showing the entire structure of an image recording apparatus (a copier) to which an automatic document conveying apparatus of the present invention is provided.

In FIG. 1, numeral 1 is a main body of a copier, numeral 2 is a scanning exposure unit, numeral 3 is an image forming means provided around a photoreceptor drum 31, numeral 4 is a copying sheet feeding means, numeral 5 is a copying sheet conveying means, numeral 6 is a fixer, numeral 7 is a reversing/discharging switching means, numeral 8 is a reversal conveying means, numeral 9 is a two-sided recording sheet conveying means (ADU), and numeral 10 is an automatic document conveying apparatus (ADC).

Figure 2:
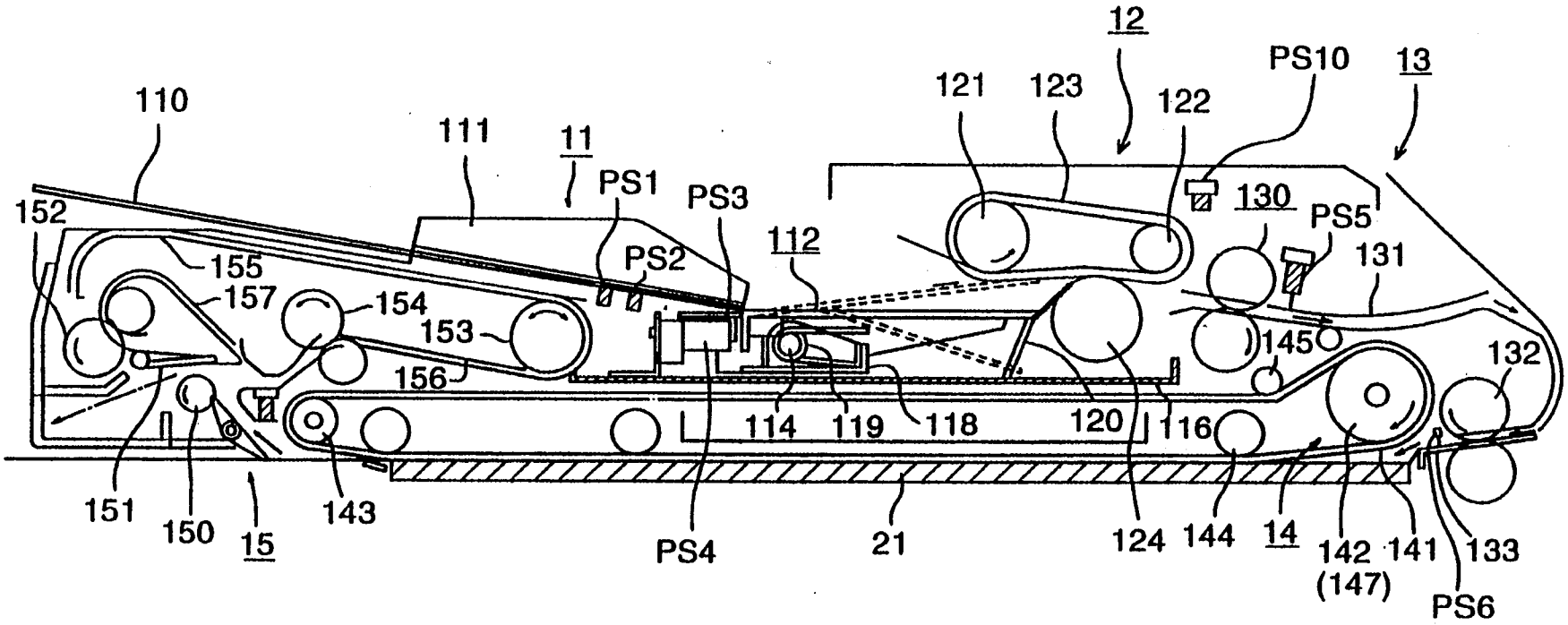
FIG. 2 is a schematic view of the automatic document conveying apparatus according to the present invention.
Figure 3:
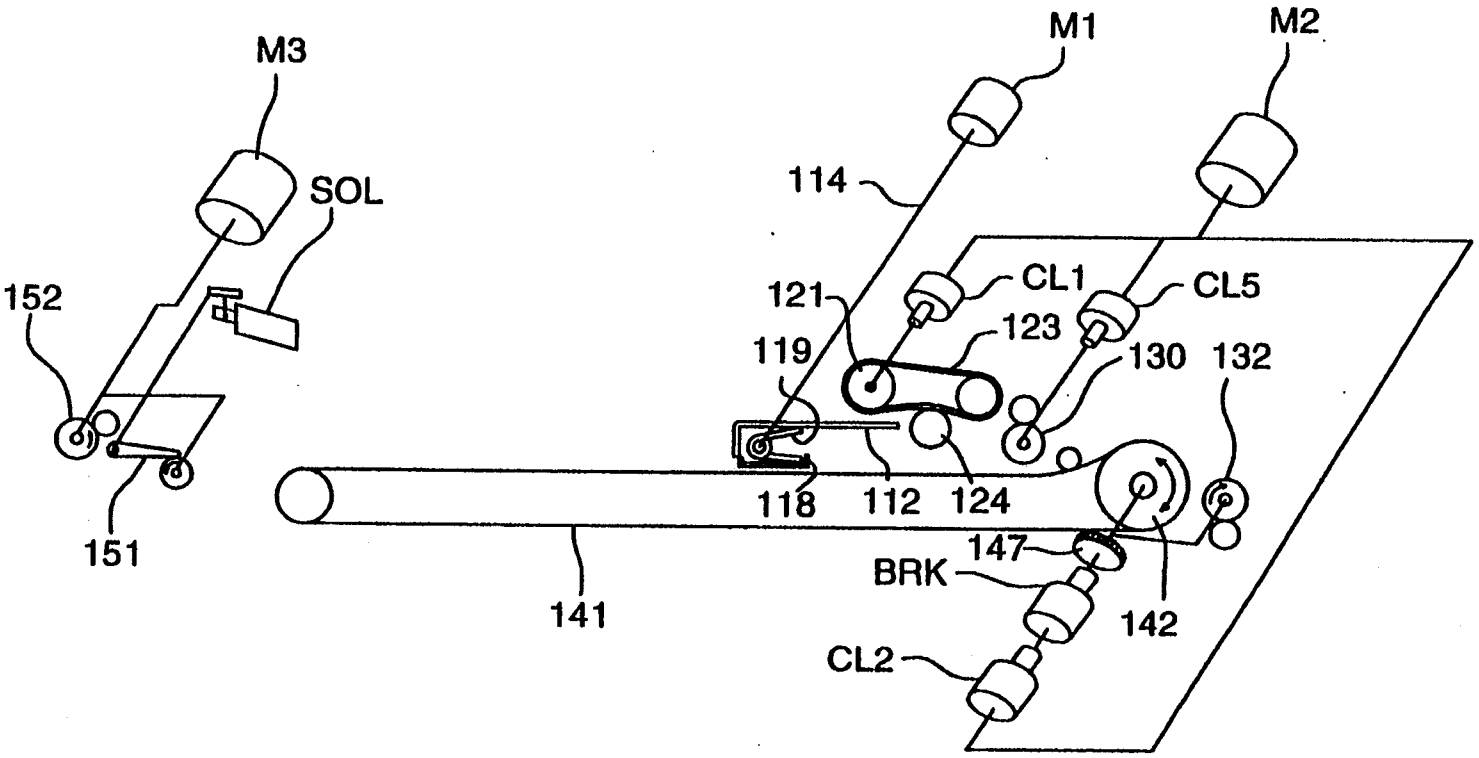
FIG. 3 is a view of the structure showing a driving system (a power transmission system) of the automatic conveying apparatus.

FIG. 2 is a schematic view of the automatic document conveying apparatus 10 according to the present invention, and FIG. 3 is a view of the structure showing a driving system (power transmission system) of the automatic document conveying apparatus.

The automatic document conveying apparatus 10 is provided on the main body of the copier 1 as shown in FIG. 1, and the apparatus 10 comprises: a document stacking section 11 on which a stack of documents is stacked; a sheet feeding section 12 (separation feeding means) by which a document sheet D is separated from the stack of the documents and fed to the following process; an intermediate conveying section 13 and conveying means 14 by which the document D, fed from the sheet feeding section 12, is conveyed to a predetermined reading position on a platen glass 21 (a document image reading section); and a discharging/reversing section 15 (discharging means) by which the document D fed by the conveying means 14 after an image exposure has been completed is discharged to a discharge tray, and by which a document, the first side of which has been read out in a two-sided copy mode, is reversed, and fed onto the platen glass 21 again.

A stack tray 110, on which a stack of documents is stacked, is provided in the document stacking section 11, and a width regulation plate 111 to regulate the width of documents is movably provided on the stack tray 110.

When the stack of documents D is stacked on the stack tray 110, the stacked documents are detected by a document setting detection sensor (a document detecting sensor) PS1, and ADC mode is displayed on a control panel of the main body of the copier 1. When the stack of documents D is set at a predetermined position, the size of the documents (B5 to A3) is detected by a document size sensor PS2, and is inputted into a control section of the main body 1 of the copier.

On the downstream end portion of the stack tray 110, a movable pressure plate 112 is pivotally provided around a shaft 114. A driving plate 118 is fixed to the shaft 114 by a screw, and the shaft 114 is integrally moved with the driving plate 118. Further, an elastic member (for example, a torsion spring) 119 is wound around the shaft 114, and its both ends press the the driving plate 118, and its central portion can presses the movable pressure plate 112.

Two actuator sections are provided on the driving plate 118, and one actuator section turns on or turns off an optical path of a pressing plate detecting sensor (for example, a photo interrupter) PS3 fixed to the movable pressure plate 112. Another actuator section turns on or turns off an optical path of a sensor (for example, a photo interrupter) PS4 fixed to a fixed base plate 116, and detects a home position of the driving plate 118.

Downstream of the movable pressure plate 112, the sheet feeding section 12 is provided. The sheet feeding section 12 comprises: a document leading edge stopper 120; a driving roller 121; a follower roller 122; a feed belt 123 around the driving roller and the follower roller; and a reverse roller 124 for double feeding prevention which is provided under the feed belt. The driving force of a driving motor M2 is transmitted to the driving roller 121 through an electromagnetic clutch CL1.

Downstream of the sheet feeding section 12, the intermediate conveyance section 13 is provided. The intermediate conveyance section 13 comprises: a pair of first intermediate conveying rollers 130 which are driven by a driving motor M2 through a conveyance clutch CL5; a document passage detecting sensor PSB; a curved guide plate 131; and a pair of second intermediate rollers 132, and forms a conveyance path by which the document D fed from the sheet feeding section 12 is conveyed to one end of the platen glass 21.

On the surface of the platen glass 21, a conveyance belt 141 is rotatably stretched around a driving roller 142, a follower roller 143, and three document pressing rollers 144. A tension roller 145 comes into contact with the surface of the conveyance belt 141 from above. A clutch CL2 and a brake BRK are provided to the shaft of the drive roller 142, and are operated by the drive force of the driving motor M2.

The discharging/reversing section 15 comprises: a discharging roller 150, a switching claw 151, a plurality of conveying rollers 152, 153, and 154, and guide plates 155, 156, and 157. The discharging roller 150 and conveying rollers 152 to 154 are driven by a discharging motor M3. The discharging roller 150 and the conveyance roller 152 are driven in a forward direction, and conveying rollers 153 and 154 are driven in forward and reverse directions. The switching claw 151 is driven by a solenoid SOL.

FIG. 4(A) to FIG. 4(H) are schematic illustrations explaining feeding, conveying, and discharging operation processes of a plurality of documents D1 to D5. In the drawings, a broken line shows the conveyance path of the two-sided document D. FIG. 5 is a timing chart showing the feeding and conveying operation processes of the document in an automatic document conveying apparatus (ADC) of the present invention.

The document feeding operation will be described as follows.

(1) In FIG. 2, when a main switch of the main body 1 of a copier is turned on, a pressing motor M1 is rotated; an initial stop position of the movable pressure plate 112 is detected by a home position detecting sensor PS4; and then, the pressing motor M1 is stopped. That is, the home position detecting sensor PS4 is turned on at the home position.

When the main switch is turned on, and the home position detecting sensor PS4 is turned off, the pressing motor M1 is reversely rotated. When it is detected that the home position. Detecting sensor PS4 is turned on, the pressing motor M1 is stopped; and the driving plate 118 and the movable pressure plate 112 are stopped at the initial position, which is the lowest position.

When the home position detecting sensor PS4 is turned on, the pressing motor M1 is rotated in a forward direction once; the home position detecting sensor PS4 is turned off; and then, the motor M1 is reversely rotated. Then, when the sensor PS4 is turned on, the motor M1 is stopped, and the driving plate 118 and the movable pressure plate 112 are positioned in the home position. This is effective for absorbing a time lag of the driving gear and sensor. In the home position, the clearance, in which a predetermined maximum amount of the document stack D can be housed, is maintained.

(2) When the document stack D is placed on the stack tray 110 and movable pressure plate 112, the document set detecting sensor PS1 is turned on, and the mode of the apparatus is changed to an ADC mode. At the same time, the document size sensor PS2 is turned on and the document size is detected.

(3) When the copy button is turned on, automatic document feeding and copying operations can be started; the pressing motor (a stepping motor) M1 starts rotation; the movable pressure plate 112 is swung through the driving plate 118 fixed to the shaft 114, and the spring 119; one end of the pressing plate 112 is elevated; and the document stack placed thereon is lifted. In this elevation process, the angle of the shaft 114 is detected when, for example, the number of pulses generated from the rotary encoder is counted.

(4) When the upper surface of the document stack D placed on the movable pressure plate 112 is contacted with the outer peripheral surface of the feed belt 123, the movable pressure plate 112 is stopped under the condition that the document stack is pinched between the pressing plate 112 and the belt [23. The driving plate 118 is further rotated counterclockwise while the torsion spring 119 is being compressed, and the space between the movable pressing plate 112 and the driving plate 118 is narrowed.

(5) When the above-described space is narrowed to a set distance, an actuator on an end of the driving plate 118 turns on a pressing force detecting sensor PS3 fixed on the movable pressure plate 112 so that the pressing force becomes an initial setting pressure (for example, 50 g); further, the pressing force is increased when the driving plate is driven; and when pulses are counted so that the pressing force of the movable pressure plate 112 becomes a predetermined value (for example, 100 g), and the pressing motor M1 is stopped. Due to the foregoing operations, document feeding preparation is completed, and the successive document feeding operation can be started.

FIG. 4(A) is a schematic illustration showing the document conveyance path of the automatic document conveying apparatus in which the document stack is placed at the document section, and which is ready for the document feeding operation. In the drawing, the image recording surface of the document stack (five sheets of the documents D1 to D5, in the drawing) is faced upward, and when the document stack is placed at a predetermined position on the stack tray 110 and the movable pressure plate 112, the automatic document conveying apparatus 10 is started and set to an ADC mode.

Figure 4:
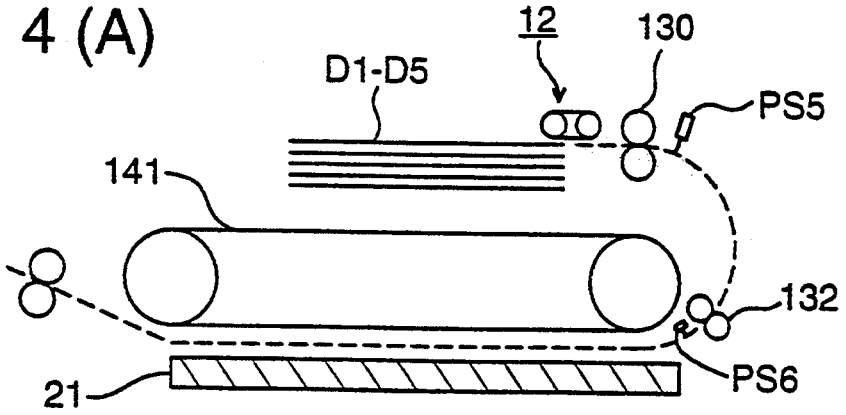
Figure 4:
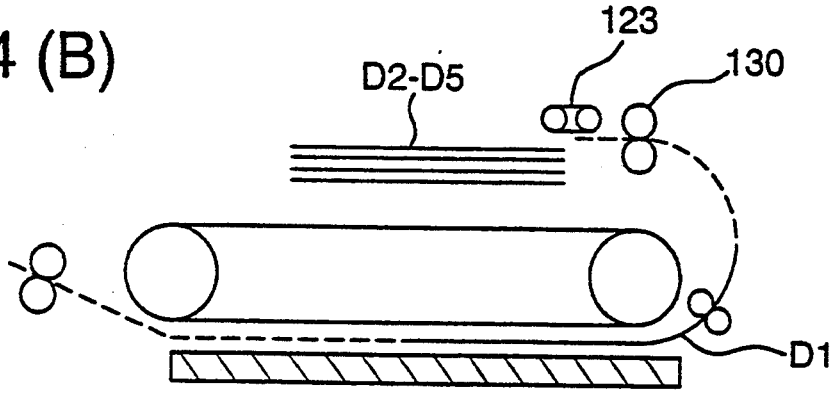
Figure 4:
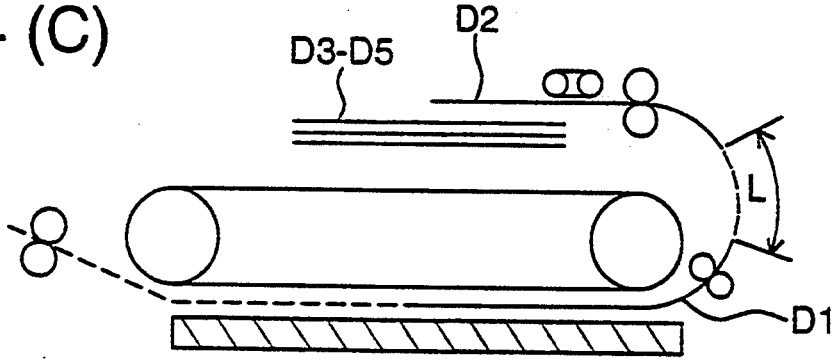
Figure 4:
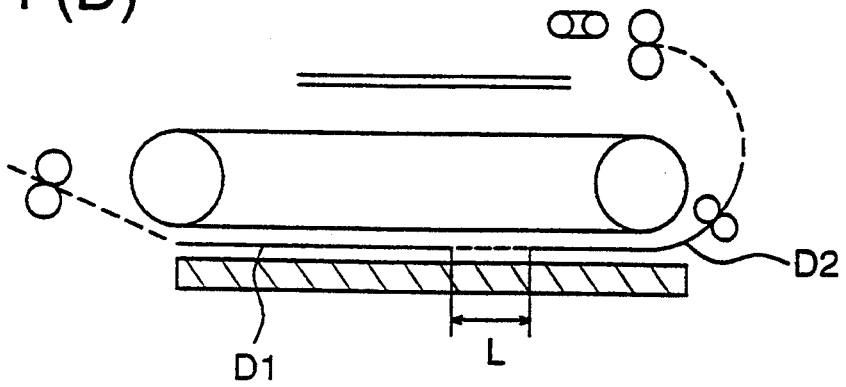
Figure 4:
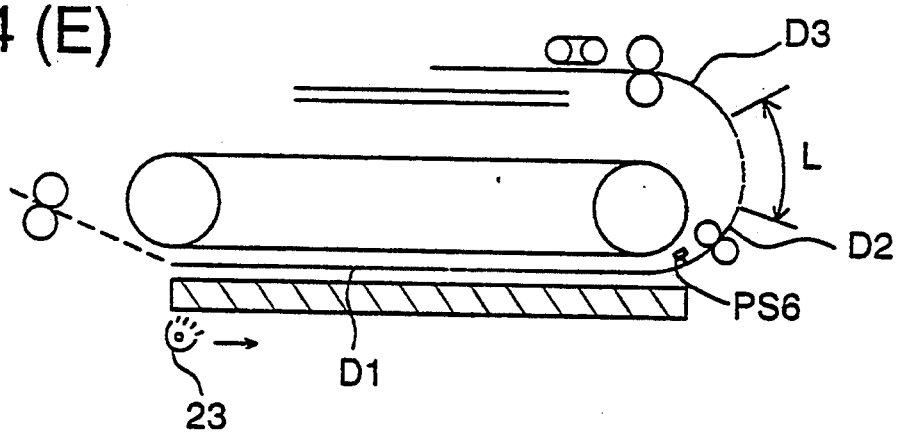
Figure 4:
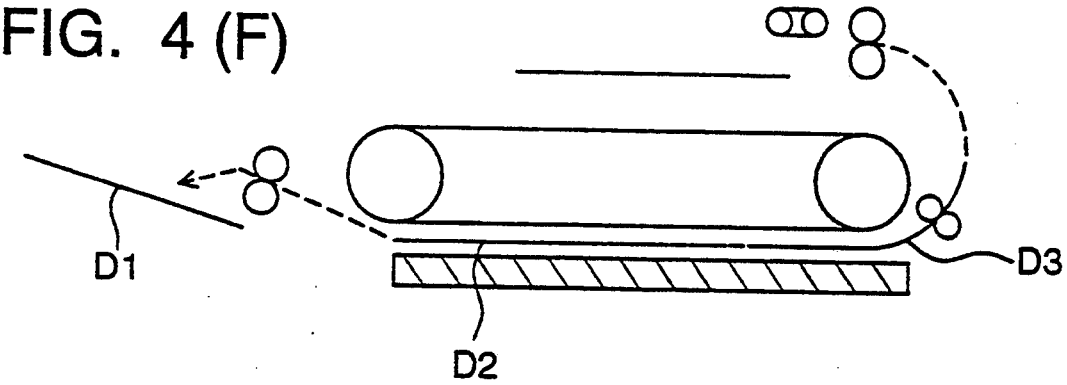
Figure 4:
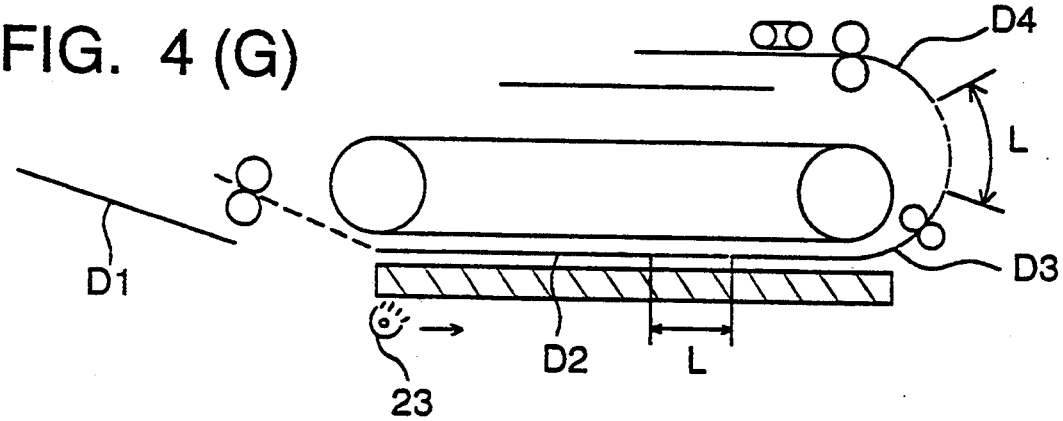
Figure 4:
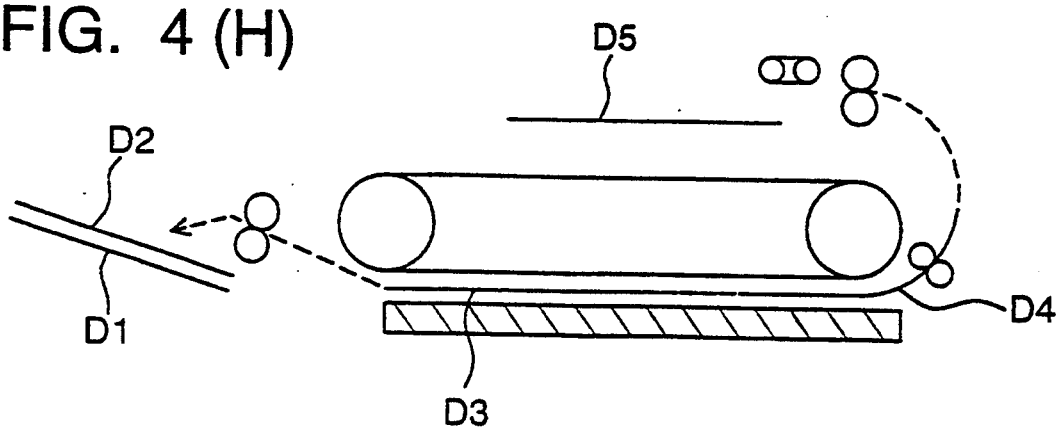
Figure 5:
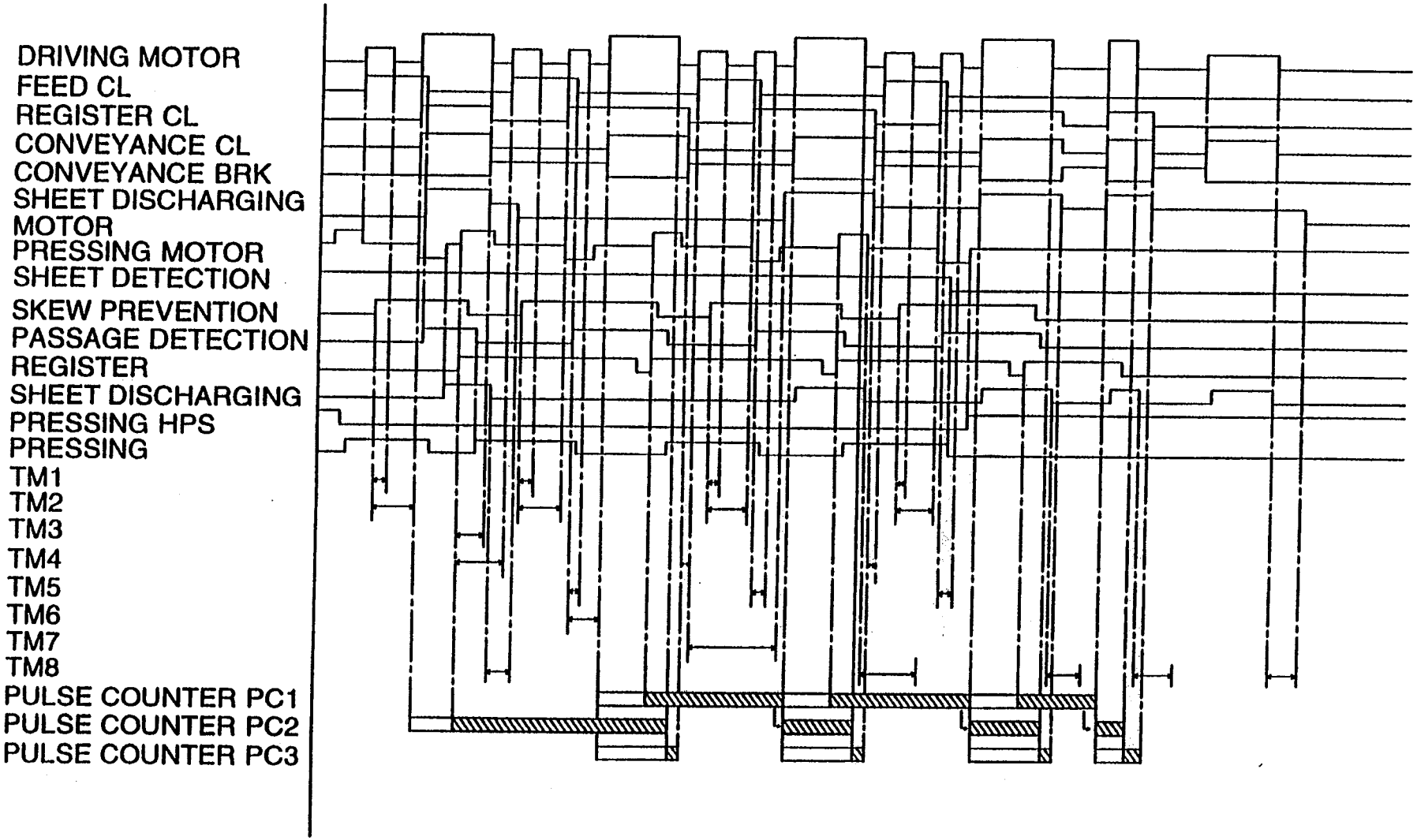
FIG. 5 is a time chart of feeding and conveying processes of the document.

Next, when the copy button on the control panel is turned on as shown in FIG. 4 (B) , the pressing motor M1 is started; the movable pressure plate 112 is elevated; the uppermost surface of the document stack is contacted with the feed belt 123 with pressure; almost at the same time, the driving motor (a main motor) M2 is turned on; at the same time, electromagnetic clutches CL1 and CL2 are turned on; and the document sheet feeding operation is started.

The uppermost document of the document stack is sent out by the feed belt 123 which is started and rotated by the driving force of the driving motor M2. Only the uppermost document D1 of a plurality of documents sent out by the reverse roller 124, is separated and fed.

When the leading edge of the document D is detected by a sheet skew correction sensor PS10, counting of the timer 1 is started, and when the elapsed time is counted up by the timer 1, the driving motor M2 is turned off. At this time, the counted value of the timer 1 is set so that the leading edge of the document is contacted with the first intermediate conveyance roller which is stopped by a turn-off operation of the conveyance clutch CL5, and the document is stopped and skew-corrected by the roller. Up to this time, when the sheet feeding speed is set to a low conveyance speed (for example, about ½ of the document exchanging speed), the sheet skew correction operation can be carried out more stably.

When the leading edge .of the document is detected by the sheet skew correction sensor PS10, counting by a timer 2 is started, and when the elapsed time is counted up by the timer 2, the driving motor M1 and clutches CL1, CL2, CL5 are turned on, and the document is conveyed again. In timed relation with this, the conveyance speed is changed to a high speed. When the leading edge of the document crosses the document passage detecting sensor PS5, the clutch CL1, by which the driving roller 121 is driven, is turned off. Although the feed belt 123 is idly rotated until the trailing edge of the document D1 has passed the sensor PS5, and after that it is stopped, the document D1 is successively conveyed by the first intermediate rollers 130.

When the document passage detecting sensor PS5 is turned on, the pressing motor M1 is reversely rotated, the driving plate 118 and the movable pressing plate 112 are lowered, and then, the pressing force is released.

When the home position detecting sensor PS4 detects that the driving plate 118 has returned to the initial position, the pressing motor M1 is stopped. When a plurality of documents are successively fed, the driving plate 118 and the movable pressure plate 112 are not returned to the home position, and the lowering drive of the driving plate 118 and the movable pressure plate 112 is intermediately stopped according to the detection signal of the pressing force detecting sensor PS3 or the drive start signal in the separation direction of the driving means.

When the trailing edge of the first document D1 passes through, and the document passage detecting sensor PS5 is turned off after a predetermined time has been counted by the timer TIM1, the driving means starts driving and pressing operations according to the detection signal so that the driving plate 118 and the movable pressure plate 112 are elevated to successively press the subsequent document.

The passage of the leading edge of the first document D1 which is sent out by the separation feeding means, and conveyed by the first intermediate conveying rollers 130, is detected by the document passage detecting sensor PS5. The document D1 passes between guide plates 131, and is fed by the second intermediate conveying rollers 132 provided downstream of the guide plates 131, and further, fed between the guide plates 133 provided downstream of the rollers 132.

Here, a register sensor PS6 (document detection means) is provided between the conveyance means 14 and the second intermediate conveying rollers 132. When the leading edge of the first document D1 is detected by the register sensor PS6, counting of the number of pulses generated by a rotary encoder 147, by which pulse signals are generated at each predetermined rotation angle of the driving roller 142 of the conveyance belt 141 (pulse signals are generated corresponding to the rotation of the conveyance belt 141), is started by the second pulse counter PC2 (refer to FIG. 5).

Next, in the conveyance means 14, the document D1 is sandwiched between the rotating conveyance belt 141 and the platen glass 21 and conveyed; when the elapsed time is counted up by the timer 3, the driving motor M2 and the clutch CL2 are turned off; at the same time, the brake BRK is turned on; and the document D1 is stopped at a predetermined position (a front portion of the reading position) on the platen glass 21.

Next, as shown in FIG. 4 (C) , when the elapsed time is counted up by a timer 4, the same sheet skew correction feeding operation as that at the time of feeding the document D1 is carried out, and when the elapsed time is counted up by a timer 5, a subsequent document D2 is stopped once after it has been nipped between the first intermediate conveying rollers. During the foregoing operations, the conveyance belt 141 is stopped, and the preceding document D1 is maintained under the condition that it is stopped at the intermediate position on the platen glass 21. The timer 3 and the timer 5 are set in the manner that the distance between the trailing edge of the preceding document D1 and the leading edge of the subsequent document D2 is a predetermined value (for example, 40 mm).

As shown in FIG. 4 (D), when elapsed time is counted up by a timer 6, rotation of the driving motor M2 is started; the first intermediate rollers 130, the second intermediate rollers 132, and the conveyance belt 141 are rotated at an equal speed; the preceding document D1 and the subsequent document D2 are sandwiched between the rollers, and are slidably conveyed on the platen glass 21 by the conveyance belt 141.

Hence, the number of pulses counted by the second pulse counter PC2, which starts counting pulses generated by the rotary encoder 147 when the leading edge of the document D1 is detected by the register sensor PS6, is equal to a value corresponding to a distance from the register sensor PS6 to a position at which the driving motor M2 is to be turned off. Then, the driving motor is turned OFF.

A third pulse counter PC3 starts counting pulses generated by the rotary encoder 147 when the driving motor M2 is turned OFF and counter PC3 counts pulses until the counted number of pulses is equal to a predetermined value. Then, when the predetermined value is reached by PC3, the clutch CL2 is turned OFF, and at the same time, a braking operation by the brake BRK is started. As a result of the foregoing, the document D1 is stopped at a predetermined reading position on platen glass 21 by the combination of the driving motor M2 which is turned OFF by the second pulse counter PC2 and the braking operation timing of the brake BRK which is controlled by the third pulse counter PC3.

That is, in the example, without using a document stopper, the movement amount of the document D is controlled when the number of pulses generated by the rotary encoder 147 is counted by pulse counters on the basis of the register sensor PS6, so that the document D is conveyed to the reading position.

In the example, before the first document D1 is stopped at a predetermined reading position, the subsequent document D2 passes the register sensor PS6. It is necessary to convey the document D2 to the reading position in the same way as the case of the document D1. In this case, the second pulse counter PC2 and the third pulse counter PC3 are used to control the conveyance of the first document D1, and therefore, the first pulse counter PC1 which is separately provided from the foregoing two counters, is reset to zero and ready for the next operation from the time of the start of conveyance of the document D1 from the intermediate stop position, and the counting operation of pulses generated by the rotary encoder 147 is started when the next document D2 passes through the register sensor PS6.

In the control of conveyance of the succeeding documents to the reading position, the first pulse counter and the second pulse counter are operated in parallel on every second sheet as shown in FIG. 5. The third pulse counter is reset at every document sheet as shown in FIG. 5. In the example, two sheets of documents are sequentially positioned in a row between the register sensor PS6 and the exposure position, and therefore operations can be carried out by two parallel pulse counters. In this case, the necessary number of pulse counters is determined according to the number of document sheets which are stopped between the register sensor PS6 and the exposure position.

The first pulse counter PC1 counts pulses from the timing of the document detection by the register sensor PS6 to the time of the document stopping at the intermediate position. The first pulse counter is switched to the second pulse counter at the timing at which conveyance of the document from the intermediate position to the reading position is started, and the first pulse counter is ready for conveyance control of the next document. Then, the turning off operation of the driving motor M2 is controlled by the second pulse counter PS2. Further, control may be repeated so that the brake BRK is operated when the number of pulses counted by the third pulse counter PS3 from the time at which the drive motor M2 is turned off is equal to a predetermined value.

As shown in FIG. 4(E), the document D1 is exposed by an exposure lamp 23 of the scanning exposure unit 2 when the document D1 is stopped on the platen glass 21, and the document image is formed on a photoreceptor drum 31 through lenses and mirrors (see FIG. 1).

Then, the same exposure as that of the foregoing is repeated by a predetermined number of copying sheets, and a sequence of copying processes is carried out from the document D1.

In the foregoing exposure operation, when elapsed time is counted up by the timer 4, the document D3 is fed out by the sheet feeding means; when the leading edge of the document is detected by the sheet skew correction sensor PS10, the timer 1 starts counting the elapsed time; and when the elapsed time is counted up by the timer 1, the driving motor M2 is turned off. At this time, the counted value of the timer 1 is set so that: the leading edge of the document is contacted with the first intermediate conveying rollers which are stopped when the conveyance clutch CL5 is turned off; and the document is stopped and skew-corrected.

When the sheet feeding speed is a low conveyance speed up to this operation (for example, about ½ of the document sheet exchanging speed), more stable sheet skew correction operation can be carried out.

When elapsed time is counted up by the timer 2, which started counting when the leading edge of the document was detected by the sheet skew correction sensor PS10, the drive motor M2, clutches CL1, and CL5 are turned on, and the document D3 is conveyed again. In timed relation with this stage, the conveyance speed is changed to a high speed. When the leading edge of the document crosses the document passage detecting sensor PS5, the timer 4 starts counting. The document D3 is nipped between the first intermediate conveyance rollers, and is ready for the next operation. The document D3 is stopped at the position at which the distance between the leading edge of the document D3 and the trailing edge of the preceding document D2 is equal to a predetermined value L1. In this example, the distance from the trailing edge of the preceding document to the leading edge of the subsequent document is controlled to be equal to a predetermined value. However, it may be allowable that the distance from the leading edge of the preceding document D to that of the subsequent document D is controlled.

Accordingly, at this time, three documents D1 to D3 are sequentially positioned in a row with a predetermined space therebetween on the conveyance path from the separation feeding means to the reading section. At this time, the document D1 is placed at the reading position of the platen glass 21; the document D2 is ready for the next operation at the position at which it bridges the space between the conveyance belt 141 and the second intermediate rollers 132 (the second conveying rollers); the document D3 is ready for the next operation at the position at which it bridges the space between the separation feeding means and the first intermediate rollers 130; and the documents D2 and D3 are ready for the next operation under the condition that succeeding conveyance can be stably carried out.

As shown in FIG. 4(F), when the driving motor M2 is rotated after the exposure operation of the document D1 has been completed, the conveyance belt 141 is rotated, and the exposed document D1 passes through the discharging/reversing section 15 and is discharged onto the discharge tray 158 provided outside the apparatus. At the same time, the subsequent document D2 which is ready for the following operation is slidably conveyed onto the platen glass 21. Here, as described above, the counting operation of the first pulse counter PC1 which is ready for the next counting operation while the preceding counting operation is stopped once, is started again. Then, the driving motor M2 is stopped according to the counted value of the first pulse counter PC1, and the operation timing of the brake BRK is controlled according to the counted value of the third pulse counter PC3 so that the document D2 is stopped at a predetermined reading position. Further, when the subsequent document D3 crosses the register sensor PS6 by the same operation as the foregoing, the counting operation by the second pulse counter PC2 is started, and then stopped once when the preceding document D2 is stopped.

As shown in FIG. 4 (G) , the subsequent document D4 is fed during the exposure operation of the document D2, and then stopped at the position which is apart from the leading edge of the subsequent document D3 by the distance L.

As shown in FIG. 4(H), after the document D2 has been exposed, the exposed document D2 is discharged; at the same time, the document D3 which is ready for the next operation on the platen glass 21 is conveyed to the exposure position; and at the same time, the subsequent document D4 is conveyed to a ready position at which the document D4 is ready for the next operation, keeping the distance L from the leading edge of the preceding document D3.

The foregoing sheet feeding and conveying operations are repeated thereafter, and when exposure processing of a final document (D5) has been completed, and the document D5 has been discharged, all the document stack is stacked on the discharge tray.

As described above, according to the present invention, the leading edge of the subsequent document D is ready for the next operation at the position at which it is sandwiched between the platen glass 21 and the conveyance belt 141, together with the document being read. A plurality of documents are sequentially positioned in a row on the conveyance path, and therefore, the distance between the document being read and the next document can be reduced, so that an operation time from when the document which has been read out is discharged, to the time in which the next document is conveyed to the reading position, can be shortened. Further, in the example, when the document is stopped at the reading position, the document stopper is not used, but the movement amount of the document is detected and controlled according to the number of pulses generated by the rotary encoder 147. Accordingly, positioning accuracy at the reading position can be stable, and a mechanism, by which the document stopper is placed on and withdrawn from the platen glass, can be omitted.

Further, in order to shorten the document exchanging time, a plurality of documents are sequentially positioned in a row between the reading position and the separation feeding means. Therefore, even when two sheets of documents are positioned between the register sensor PS6, which is a reference of the reading position control, and the reading position, two pulse counters PC1 and PC2 are parallel-processed with respect to each document, and therefore, the movement amount of each document can be controlled.

Although a conveyance process of one-sided documents is shown in the example, document conveyance properties can be improved in a copy mode of two-sided documents in a reversible document conveying apparatus (RDC) by the same operation as that of the one-sided documents. Further, it is clear that the same operation can be carried out in an RDC, which has a U-turn reversing path in the sheet discharging side, or a recirculating document handler (RDH).

As described above, according to the automatic document conveying apparatus of the present invention, documents are successively conveyed in the manner that a plurality of documents are sequentially positioned in a row between the document separation feeding means and the reading section, and the distance between the document being read and the next document can be greatly shortened. Accordingly, the document conveyance time can be shortened, and the copying efficiency can be greatly improved.

Further, when the document is positioned at the reading position, the document does not come into contact with the document stopper, but the document is conveyed according to the detection of the movement amount of the document on the basis of the document detection. Accordingly, positioning can be accurately carried out stably, and a mechanism by which the document stopper is placed on and withdrawn from the platen glass can be omitted, so that the mechanism can be made simple.

Further, even when a plurality of documents are positioned between the document detecting position and the reading position, the movement amount of each document can be controlled, and it is not necessary to extend the intervals between the documents for the purpose of controlling the movement amount. Therefore, the reduction of the document exchange time and the movement amount control of each document can be compatible with each other.

What is claimed is:

1. An automatic document conveying apparatus comprising:

(a) a stacker on which a stack of documents is stacked;

(b) a feeder for separating and feeding said documents, one by one, from said stacker;

(c) at least. one pair of conveyance rollers positioned in a downstream feeding direction, downstream of said feeder, for conveying a separated one of said documents;

(d) a reading position provided in said downstream feeding direction, downstream of said at least one pair of conveyance rollers, at which image information on said separated one of said documents is read by a reader;

(e) conveyance means for conveying said separated one of said documents to said reading position;

(f) discharging means for discharging said separated one of said documents conveyed downstream of said reading position;

(g) a conveyance path on which a plurality of documents are sequentially disposed in said downstream feeding direction, said conveyance path being positioned between said feeder and said reading position;

(h) detecting means disposed between said at least one pair of conveyance rollers and said conveyance means, for detecting a document therebetween;

(i) an encoder for generating a pulse signal corresponding to a rotation of said conveyance means;

(j) a plurality of pulse counters, each of said plurality of pulse counters counting a number of pulses generated by said encoder, each of said plurality of pulse counters starting a counting of said pulses when an edge portion of a document which corresponds to one of said plurality of pulse counters is detected by said detecting means; and (k) control means, for controlling a conveyance of each document conveyed by said conveyance means along said conveyance path to said reading position, according to each of the counted number of pulses counted by each of said plurality of pulse counters based on a timing of an output of said detecting means;

wherein said control means controls a conveyance of each of the documents disposed between said detecting means and said reading position according to said counted number of pulses corresponding to a respective movement of each of the documents which are moved at the same time along said conveyance path.

2. The apparatus of claim 1, wherein a driving of said conveyance means is stopped according to a counted number of pulses of each of said plurality of pulse counters after said detecting means detects a document.

3. The apparatus of claim 1, wherein:

said at least one pair of conveyance rollers comprises a first pair of conveyance rollers and a second pair of conveyance rollers located downstream of said first pair of conveyance rollers;

a second document successive to a first document positioned on said reading position, stands by at a position between said conveyance means and said second pair of conveyance rollers;

and wherein a document closest to said stacker stands by at a position between said feeder and said first pair of conveyance rollers.

4. The apparatus of claim 2, wherein:

said at least one pair of conveyance rollers comprises a first pair of conveyance rollers and a second pair of conveyance rollers located downstream of said first pair of conveyance rollers;

a second document successive to a first document positioned on said reading position, stands by at a position between said conveyance means and said second pair of conveyance rollers;

and wherein a document closest to said stacker stands by at a position between said feeder and said first pair of conveyance rollers.

5. The apparatus of claim 1, wherein said plurality of pulse counters are equal in number to a number of documents which are disposed between said detecting means and said reading position.

6. The apparatus of claim 1, wherein said conveyance path comprises a plurality of predetermined waiting positions provided thereon such that each of said documents is read by said reader at said reading position.

7. The apparatus of claim 2, wherein said conveyance means further comprises:

a brake member for stopping a movement of said conveyance means; and another pulse counter for counting a number of pulses generated by said encoder, and wherein:

a movement of said conveyance means is stopped by said brake member being operated, based on a predetermined counted number of pulses of said another pulse counter after said driving of said conveyance means is stopped so that a document is stopped at said reading position.

8. The apparatus of claim 7, wherein said conveyance means further comprises a clutch member for enabling a driving of said conveyance means, based on said predetermined counted number of pulses of said another pulse counter.

9. The apparatus of claim 1, wherein said detecting means detects a leading edge portion of the document.

* * * * *